US008302950B2

(12) United States Patent
Terhaag et al.

(10) Patent No.: US 8,302,950 B2
(45) Date of Patent: Nov. 6, 2012

(54) PRINTING SYSTEM AND FOLDING MODULE

(75) Inventors: Michiel A. C. Terhaag, Melick (NL); Marco H. L. H. Kusters, Spaubeek (NL); Jeroen A. A. Van Assen, Waalre (NL)

(73) Assignee: OCE-Technologies B.V., Venlo (NL)

( * ) Notice: Subject to any disclaimer, the term of this patent is extended or adjusted under 35 U.S.C. 154(b) by 0 days.

(21) Appl. No.: 12/753,564

(22) Filed: Apr. 2, 2010

(65) Prior Publication Data

US 2010/0201057 A1 Aug. 12, 2010

Related U.S. Application Data

(63) Continuation of application No. PCT/EP2008/062863, filed on Sep. 25, 2008.

(30) Foreign Application Priority Data

Oct. 5, 2007 (EP) ..... 07117954

(51) Int. Cl.
*B41L 43/00* (2006.01)

(52) U.S. Cl. ..... 270/32; 270/20.1; 270/58.07

(58) Field of Classification Search ..... 270/4, 20.1, 270/32, 39.01, 45, 58.07; 399/110, 407
See application file for complete search history.

(56) References Cited

U.S. PATENT DOCUMENTS

| | | | | |
|---|---|---|---|---|
| 6,024,682 | A | 2/2000 | Mandel et al. | |
| 6,947,684 | B2 * | 9/2005 | Fujii et al. | 399/90 |
| 7,410,156 | B2 * | 8/2008 | Ikeda et al. | 270/37 |
| 2003/0199377 | A1 | 10/2003 | Driggers | |
| 2006/0176336 | A1 | 8/2006 | Moore et al. | |
| 2006/0180970 | A1 | 8/2006 | Mimura et al. | |
| 2007/0052148 | A1 * | 3/2007 | Kubo | 270/58.08 |
| 2007/0161489 | A1 * | 7/2007 | Ikeda et al. | 493/444 |

FOREIGN PATENT DOCUMENTS

| | | | |
|---|---|---|---|
| EP | 0 762 225 | | 3/1997 |
| EP | 1 241 532 | | 9/2002 |
| JP | 05116834 A | * | 5/1993 |
| WO | WW 2009/043805 | | 4/2009 |

* cited by examiner

*Primary Examiner* — Leslie A Nicholson, III
(74) *Attorney, Agent, or Firm* — Birch, Stewart, Kolasch & Birch, LLP

(57) ABSTRACT

A printing system includes a media storage module, a printing station for processing a portion of the receiving media, a receiving station for receiving the processed media, and a base member for supporting the printing system on a support surface. A receiving device is configured to receive a folding module for folding the processed receiving media. The receiving device is positioned substantially in a volume extending from the area defined by the cumulative normal projection of the media storage module and the printing station on the support surface, the volume extending perpendicular to the support surface in the direction of the printing station. A guiding device is configured to guide the processed media to one of the receiving station and the folding module. A method of modifying the printing system includes removing a media storage module to create a vacancy and inserting a folding module into the vacancy.

16 Claims, 7 Drawing Sheets

PRINTING SYSTEM AND FOLDING MODULE

CROSS-REFERENCE TO RELATED APPLICATIONS

This application is a Continuation of copending PCT International Application No. PCT/EP2008/062863 filed on Sep. 25, 2008, which designated the United States, and on which priority is claimed under 35 U.S.C. §120. PCT International Application No. PCT/EP2008/062863 claims priority to Application No. 07117954.3 filed in Europe on Oct. 5, 2007. The entire contents of each of the above-identified applications are hereby incorporated by reference.

FIELD OF THE INVENTION

The present invention relates to a printing system and a folding module for folding a processed receiving media. The present invention also pertains to a combination of the printing system and the folding module and to a method of modifying a printing system.

DESCRIPTION OF BACKGROUND ART

Printing systems that are in-line coupled to a folding system are known. In these kinds of systems, the printing system applies marking material on a portion of a receiving media and outputs the processed media via an output of the printing system towards the input of the folding system. Usually, the folding system comprises a large substantially flat table to support the processed media and apply one or more alignment and measuring operations to determine the folding program. The table is used to ensure a correct alignment. It is a disadvantage of these types of folding systems that they occupy a large floor area additional to the floor area occupied by the printing system.

SUMMARY OF THE INVENTION

It is an object of the present invention to provide for a folding system that enables a reduction of floor space needed for the combined printing and folding system. To this end, the present invention is directed to a printing system and a folding module for folding a processed receiving media from the printing system.

By placing the folding module in a vacancy in the printing system, wherein the cooperation device of the folding device engages with the receiving device of the printing system, wherein the receiving device is positioned within an imaginary volume extending perpendicular from the footprint area in the direction of the printing station, the folding module does not require additional footprint space.

The footprint of the printing system is the area defined by the cumulative normal projection of the media storage module and the printing station on the support surface. This area is commonly referred to as the footprint of the media storage module and the printing station. The footprint area is the area of the imaginary perpendicular projection on the support surface of the media storage module added to the imaginary perpendicular projection on the support surface of the printing station. For the determination of the footprint area, the support surface is represented as a mathematical plane span by the points on which the base member is supported on the physical support surface.

In an embodiment of the folding module according to the present invention, the folding module comprises a cooperation device positioned at the circumference of the folding module for cooperation with the receiving device of the printing system, and a folding device configured to fold the processed receiving media. The cooperation device enables the folding module to be placed in the printing system. This placement may have a temporarily character or a permanent character. An operator may replace a module comprising, for example rolls of receiving media, such as paper, by a module comprising a folder, or by a module comprising a folder and an additional roll of receiving media.

In a further embodiment, the folding module comprises a media feed device configured to feed a media into the folding device. The media feed device enables a processed media to be transported into the folding device, such that a folding operation may be executed on the processed receiving media.

In a further embodiment, the folding module comprises a media feed device, which in an operative state is able to correct for media skew. Commonly, an in-line or off-line folding system requires a large input table to measure a receiving media which is to be folded, and for measuring and correcting for any skew before folding. Such a large input table increases the footprint of the system significantly. This media skew correction may be implemented by driving the media feed device in opposite direction with respect to the media transport direction, such that a processed receiving media is skew corrected before it is fed to the folding device. Thereby, the skew correction device does not increase the footprint area of the system, while maintaining the skew correction quality.

In an embodiment of the folding module according to the present invention, the folding means comprises a rotatable folding cylinder, a first and a second rotatable press member, each capable of engaging with said folding cylinder to form respectively a first and a second folding pinch, a medium feed device configured to feed the medium towards the folding cylinder in between said first and second folding pinches, and a control device that is capable of alternating the rotational direction of the rotatable folding cylinder in operative state during a folding program and controllably drive the medium feed means to feed the medium during a folding program towards the folding cylinder.

This process of folding a processed receiving media enables the folding operation to be carried out by a relatively compact folding system. The compactness of the folding system enables this folding process to be carried out in a volume equal to a volume needed for storing rolls of receiving material. Therefore this method of folding a processed receiving media is very suitable for implementing in the folding module according to the present invention.

In a further embodiment, the medium feed device is positioned in close proximity to the folding cylinder. By placing the media feed device in close proximity to the folding cylinder, the footprint of the system is not increased and the available space is used optimally to accommodate larger packages to be folded.

In an embodiment, the folding module further comprises an output device, configured to eject a folded processed media. The output device may comprise a transport pinch for transporting a folded package to a location reachable for an operator to take out the folded package. This may be the same location as the location where sheets are delivered to when a folding operation is not required.

In an embodiment, the folding module further comprises a storing device for storing at least one roll of receiving media. In particular, if the folding module replaces a module intended for storing rolls of receiving media, it is very advantageous to accommodate an additional roll of receiving media if the folding device does not cover the complete available volume.

In another embodiment, the folding has substantially the same outside dimensions as a media storage module for storing at least one roll of receiving media of the printing system. This enables exchangeability between a roll storage module and a folding module according to the present invention. By implementing such folding module, the footprint of the system is not increased, while a folding functionality is added.

In another aspect, the present invention pertains to a combination of the printing system and the folding module. Such combination adds a folding functionality to the printing system without adding to the required floor space of such a system. In particular in applications where floor space is scarce, such combination will be appreciated.

In another aspect, the present invention relates to a method of modifying a printing system, comprising the steps of removing a media storage module capable of storing at least one roll of receiving media from a printing system, thereby creating a vacancy, and inserting a folding module into the vacancy.

Such modification adds a folding functionality to the printing system without adding to the required floor space of such a system. In particular, in applications where floor space is scarce, such combination will be appreciated. It will be clear for one having skill in the art that any electrical signals required for operating the folding module shall be installed after placement of the folding module.

In a further embodiment of the method, the media storage module and the folding module are removably connectable to the printing system by means of a receiving device. This enables the exchangeability of the folding module and, for example, a module comprising one or more rolls of receiving media. Such a configurable system adds a significant functionality to be selected, while an operator may still chose to prefer the storage capacity if needed to store more rolls.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
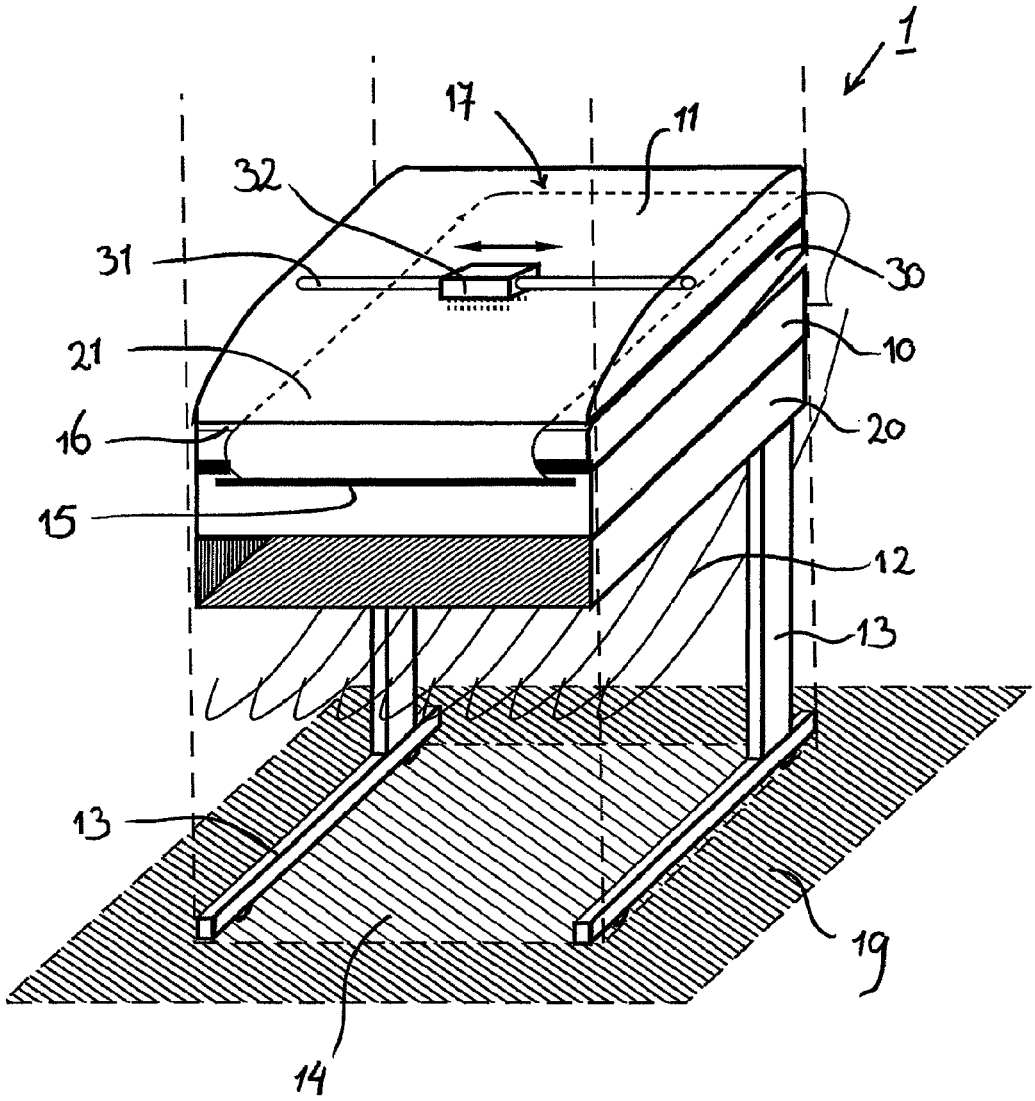
FIG. 1 is a schematic view of an embodiment of a printing system according to the present invention.

The present invention will now be described with reference to the accompanying drawings, wherein the same or similar elements have been identified with the same reference numeral.

FIG. 1 is a schematic view of an embodiment of a printing system 1 according to the present invention. The printing system 1 comprises a media storage module 10. The media storage module 10 has the capacity to store two rolls of receiving media, in this system two rolls of wide format paper (not shown). The rolls of paper are mounted in the media storage module 10 such that the paper can be drawn out to be processed, e.g. by driving the axles on which the rolls are mounted or by drawing the media out by a media transport pinch.

The receiving media 21 is fed out of the media storage module 10 via the exit 15 of the media storage module 10. The receiving media 21 is fed into the printing station 30 via the entrance 16 of the printing station 30. In the printing station 30, several media transport pinches (not shown) feed the receiving media 21 towards the imaging device. The imaging device comprises a printhead 32 mounted on a carriage 31. The printhead 32 is drivably mounted such that the printhead 32 is able to make a scanning movement in a direction perpendicular to the direction of media transport. The printhead 32 comprises a plurality of nozzles (not shown) and a device for applying marking material through the nozzles to the receiving media 21 in an image wise fashion.

The processed receiving media 11 is fed by means of media transport pinches (not shown) towards the exit 17 of the printing station 30. The printing system 1 further comprises a cutting device (not shown) for cutting the processed receiving media 11 at the required length dimension of the processed receiving media 11, thereby separating the processed receiving media 11 from the stretch of receiving material on the roll in the media storage module 10. The cut, processed receiving media 11 is received in the receiving station 12. This receiving station 12 is mounted in between the legs of the base member 13 and is implemented as a wire frame construction slide. The base member 13 supports the printing system 1 on the support surface 19. An area 14 bounded by the dashed line segments represents the cumulative normal projection of the media storage module 10 and the printing station 30 on the support surface 19. This area 14 is commonly referred to as the footprint of the media storage module 10 and the printing station 30. Footprint area 14 is the area of the imaginary perpendicular projection on the support surface 19 of the media storage module 10 added to the imaginary perpendicular projection on the support surface 19 of the printing station 30. For the determination of the footprint area 14, the support surface 19 is represented as a mathematical plane span by the points on which the base member 13 is supported on the physical support surface 19.

The printing system 1 comprises a further module, depicted as vacancy 20 suitable for receiving a folding system and/or a further media storage module. This further module 20 comprises a receiving device configured to receive a folding system. The receiving device is positioned in an imaginary volume extending perpendicular from the footprint area 14 in the direction of the printing station 30.

Figure 2A:
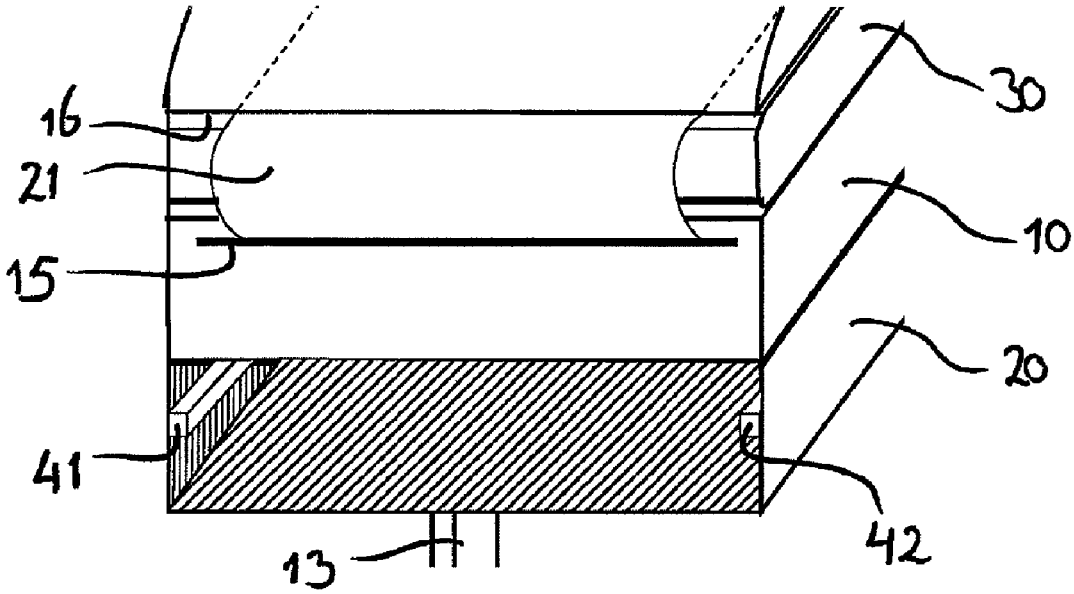
FIG. 2A schematically shows a detail of such printing system.
Figure 2B:
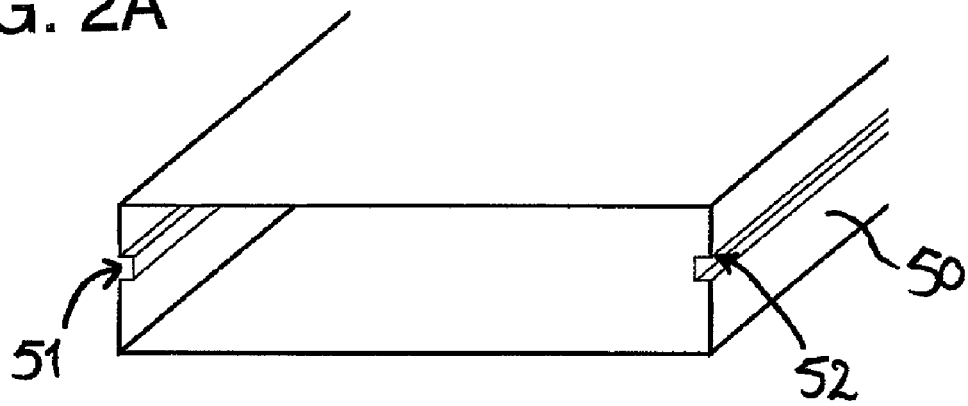
FIG. 2B schematically shows an embodiment of a folding module.

FIG. 2A schematically illustrates a detail of the printing system 1 as depicted in FIG. 1. Vacancy 20 comprises a receiving device 41 and 42. In this embodiment the receiving device 41 and 42 is implemented as a drawer rail. This receiving device 41 and 42 is fitted to cooperate with the cooperation device 51 and 52 of a folding station 50, as schematically shown in FIG. 2B. The cooperation device 51 and 52 and/or the receiving device 41 and 42 comprise a rolling device (not shown) to improve the relative motion of the folding module 50 during the introduction of the folding module 50 into the printing system 1.

Figure 3:
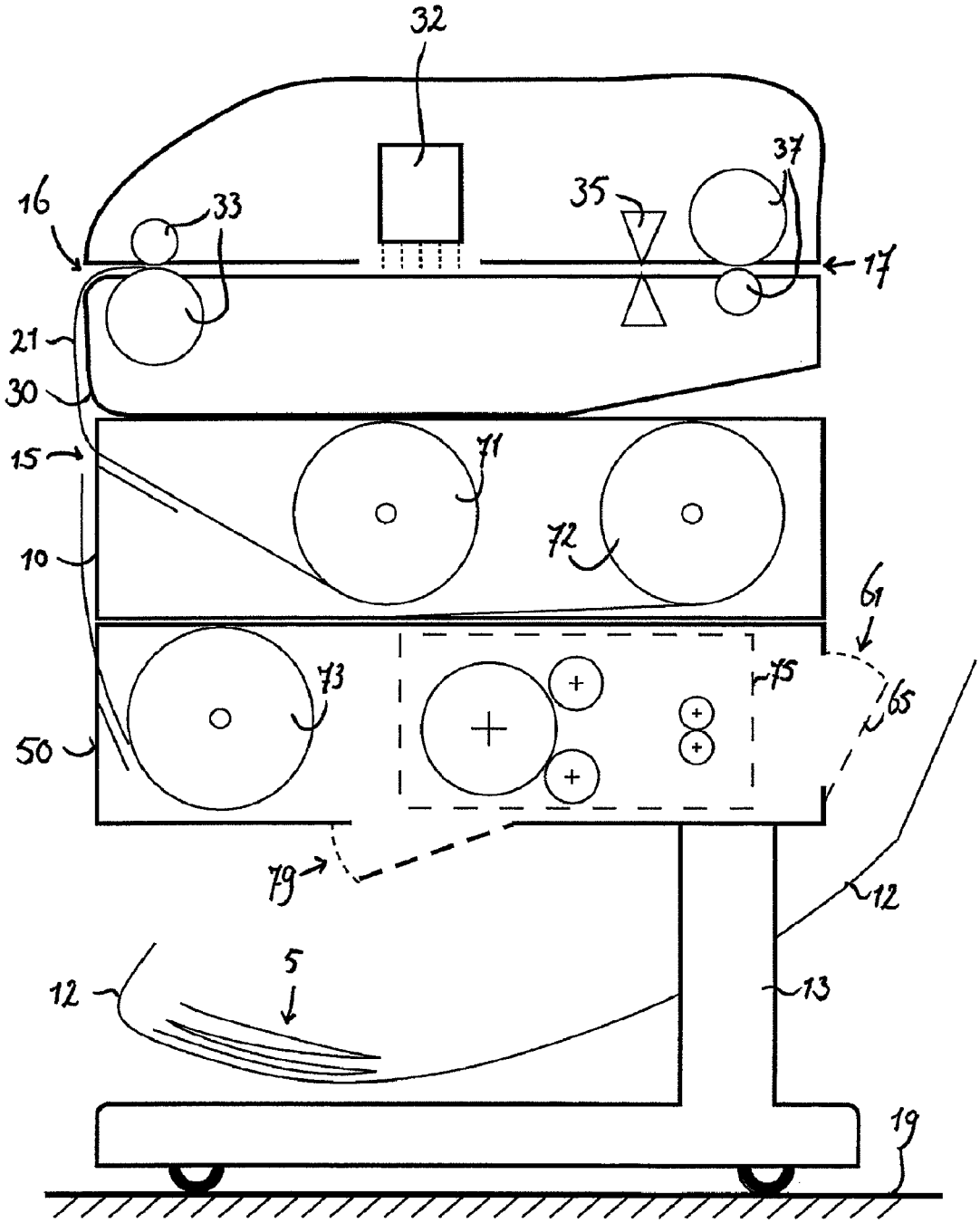
FIG. 3 illustrates a schematic side view of an embodiment of a printing system incorporating an embodiment of a folding module.

FIG. 3 is a schematic side view of an embodiment of a printing system 1 incorporating an embodiment of a folding module 50 according to the present invention. Media storage module 10 comprises a first roll of receiving media 71 of which the leading edge is fed into media transport pinch 33 and a second roll of receiving material 72, which is currently not fed into the printing station 30, but which leading edge is engaged such that it may be fed into the printing station, for example when roll 71 is empty. Roll 71 and roll 72 may contain the same or different type of receiving material. Types may, e.g. vary in their width, roll length, or surface type of receiving material (glossy, matte, etc.).

The stretch of receiving material is fed via the exit 15 of media storage module 10 through the entrance of the printing station 30. In practice, the printing system will comprise several transport pinches over the length of the paper paths, but these are not all shown.

The receiving material 21 is fed under the printhead 32 and towards the cutting device 35. The cutting device 35 is positioned downstream of the printing location, but it shall be clear that the cutting device may also be positioned at other locations in the system, such as upstream of the printhead 32 or even inside the media storage module 10.

The processed receiving material is fed by transport pinch 37 via exit 17 to the exterior of the printing station 30. The processed receiving material is selectably received by either the receiving station 12 or the folding module 50. The selecting is implemented by a valve 65 near the entrance 61 of the folding module 50. By driving the valve 65 to its opened position as illustrated in FIG. 3, a processed receiving material is guided into the folding module 50 where it will be received by a further transport pinch (not shown), which enables the processed receiving media to be fed into the folding device 75. If the valve 65 is driven to its closed location, the processed receiving media will be guided into the receiving station 12, where it slides towards a user reachable delivery position, where the processed receiving media may be taken out by an operator.

The folding module 50 comprises a folding device 75 configured to execute a folding operation and an exit 79 for releasing a folded package onto the receiving station 12. The folding module 50 further comprises an additional roll of receiving material 73, which may be fed into the printing station 30 by the media transport device (not shown). The folding module 50 is here completely contained in the casing as depicted in FIG. 2B.

Figure 4:
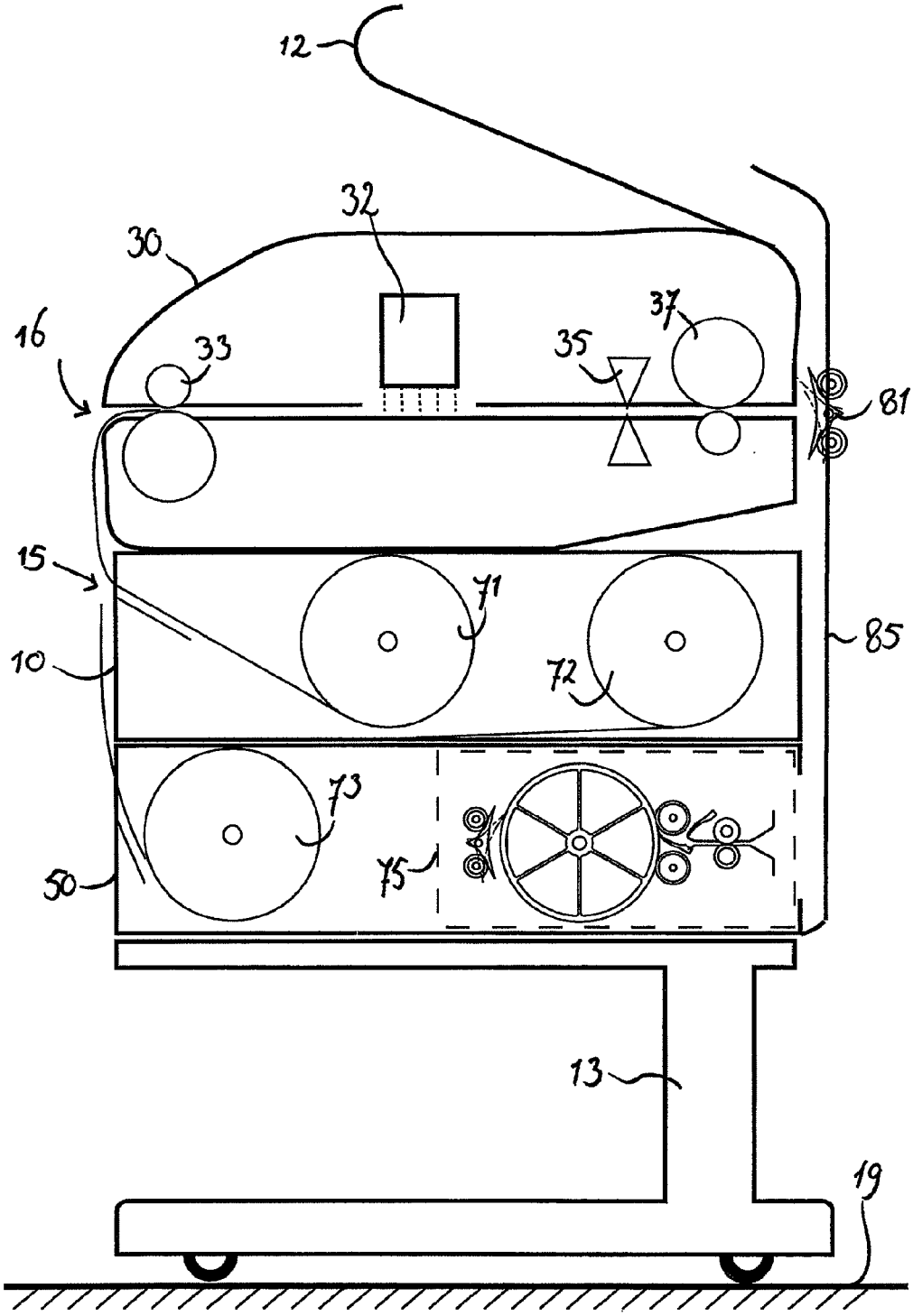
FIG. 4 is a schematic side view of an embodiment of a printing system incorporating an embodiment of a folding module.

FIG. 4 is a schematic side view of an embodiment of a printing system incorporating an embodiment of a folding module similar to the printing system as depicted in FIG. 3. This embodiment comprises an upper receiving station 12 on top of the printing station 30. A processed receiving media is selectably fed towards the folding module 50 or towards the upper receiving station 12 by the guiding device 81. By operating the guiding device 81 in a first state (indicated by dashed lines), the processed receiving media is guided towards the folding module under further guidance of the transport and guidance device 85. A folding device 75 receives the leading edge of a processed receiving media and executes a folding program to fold the processed receiving media according to a required folding configuration. In this embodiment, the folded package is fed back into the transport path as defined by the transport and guidance device 85 into the upper receiving station 12 by operating the guidance device 81 such that a transport path is formed from the folding module to the upper receiving station 12. Alternatively, the folding module may comprise an additional exit for releasing a folded package, for example underneath the folding module 50.

Figure 5:
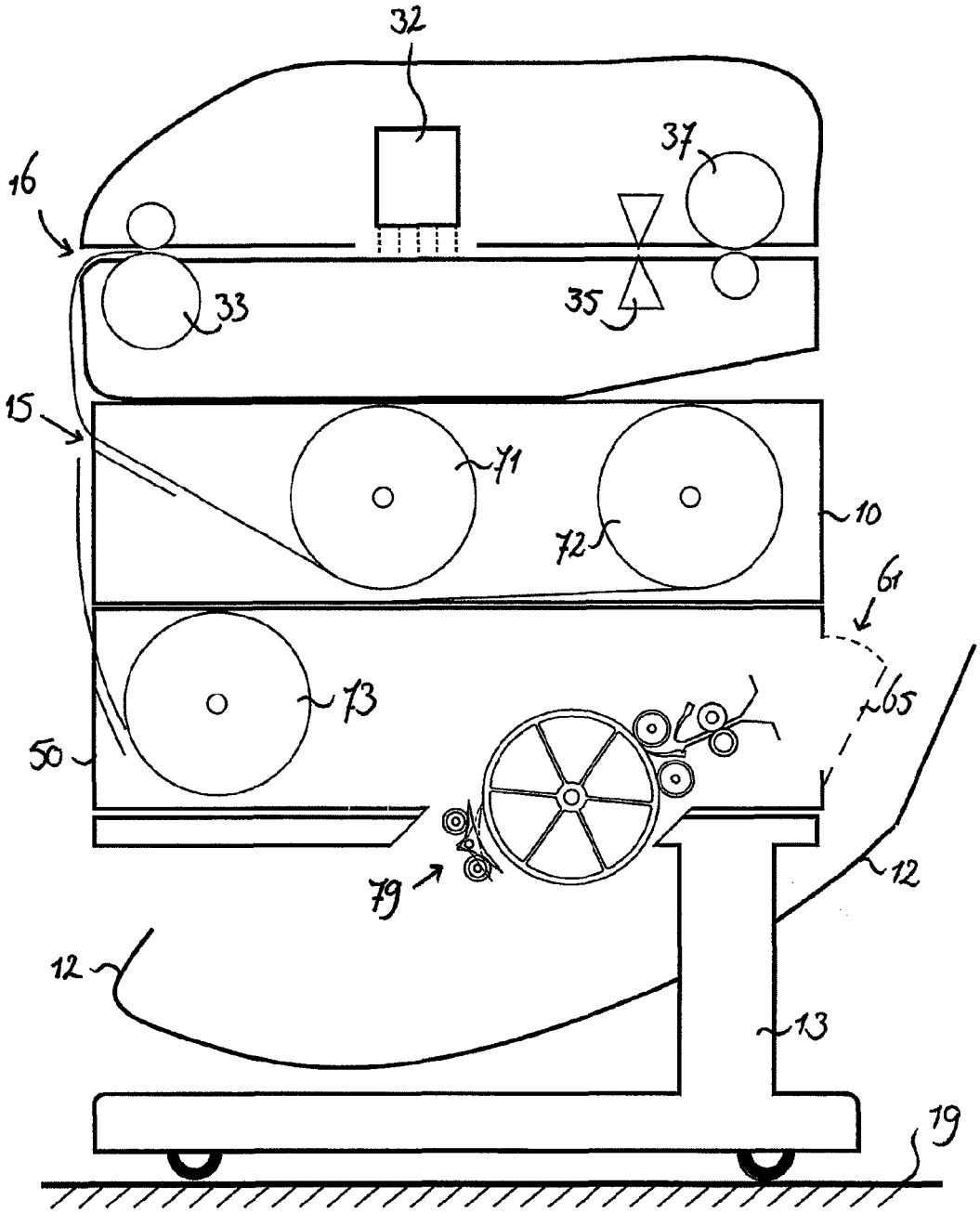
FIG. 5 is a schematic side view of an embodiment of a printing system incorporating an embodiment of a folding module.

FIG. 5 is a schematic side view of an embodiment of a printing system incorporating an embodiment of a folding module similar to the printing system as depicted in FIG. 3. The folding module 50 here comprises a folding device 75, which extends partly outside the folding module 50 towards the bottom receiving station 12. For the sake of modularity, this embodiment comprises a device for rotatably mounting the folding device 75 such that, after placing the folding module 50 into the vacancy comprising the receiving device for receiving the folding module, the complete folding device is rotated into the position as depicted here.

Figure 6:
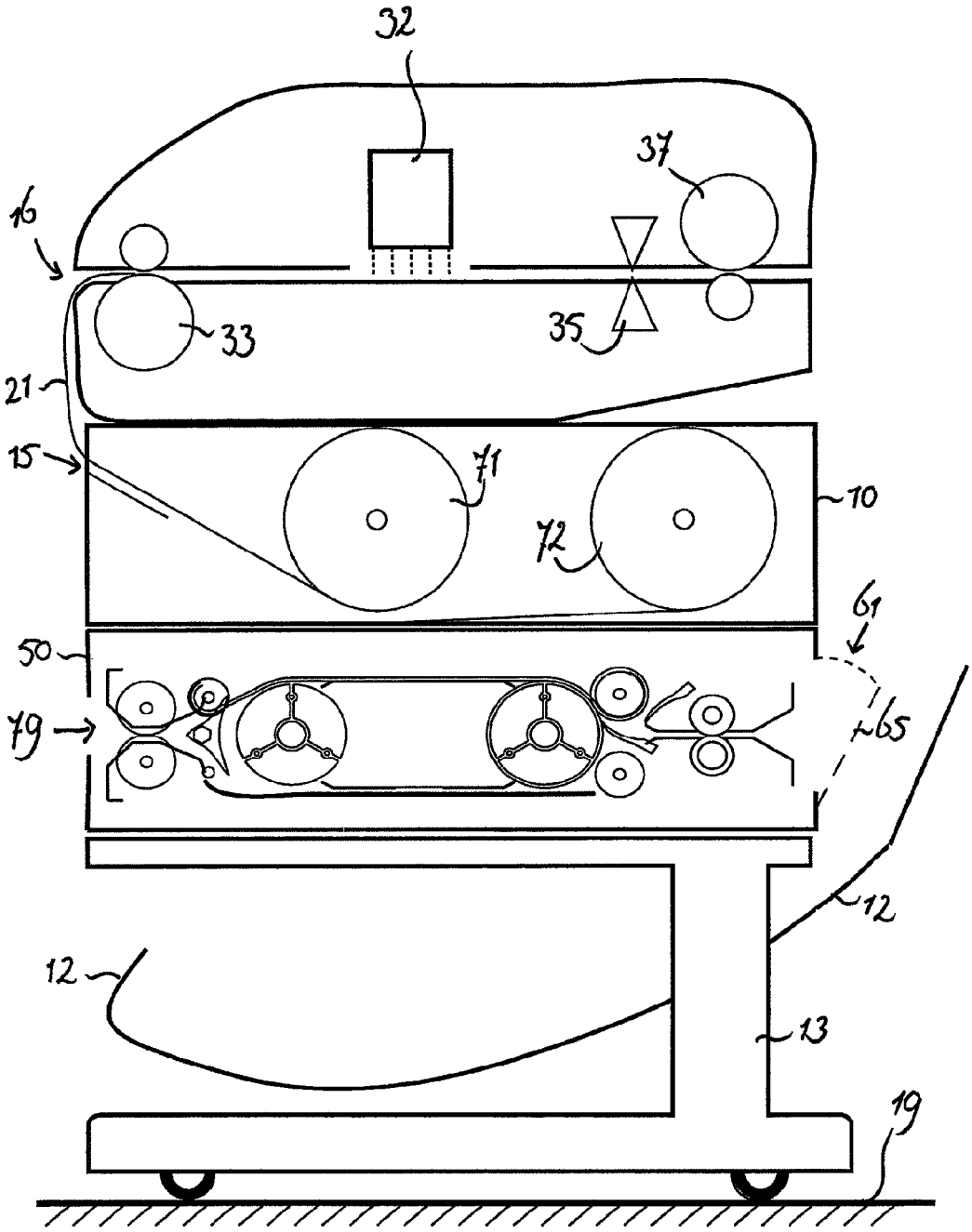
FIG. 6 is a schematic side view of an embodiment of a printing system incorporating an embodiment of a folding module.

FIG. 6 is a schematic side view of an embodiment of a printing system incorporating an embodiment of a folding module similar to the printing system as depicted in FIG. 3. This embodiment comprises a folding module 50, which comprises a selectably operable valve 65 for selectable guiding a processed receiving material into the folding device or the receiving station 12. This embodiment comprises a folding device, which is stretched in a length direction such that the central folding device takes less height, but offers the same space for long packages to be folded. The media transport path inside the folding device is formed by implementing two smaller rolls with a belt around them. The outside boundary of the transport path is implemented as a plate. Alternatively, this plate may be any other media retaining device, such as an additional belt. A folded package is released through folding exit 79 to the front of the system 1. This folding exit 79 may also be used as a separate alternative entrance for guiding separate sheets of media into the folding device. In this way, the folding module may be used as an in-line folder via the entrance 61 and as an off-line folder, where an operator manually feeds sheets into the folder via entrance 79.

The folding module may comprise any folding device small enough to fit in a module suitable to be placed in vacancy 20 as depicted in FIG. 2A. FIGS. 7A-7D illustrate some well working examples of folding devices suitable to be implemented in such a limited space.

Figure 7A:
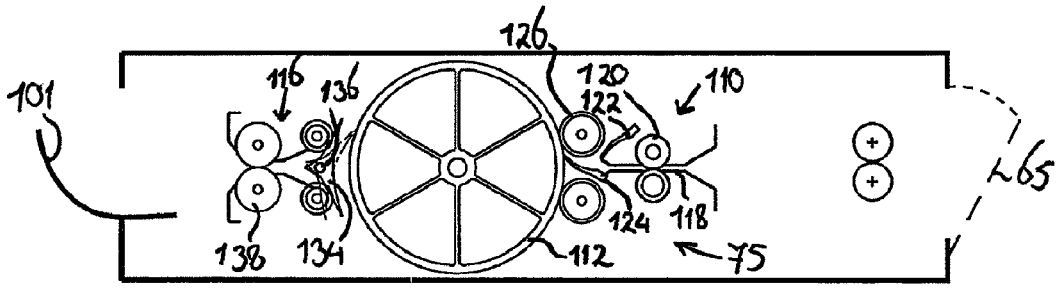
FIGS. 7 A-D are schematic side views of an embodiment of a folding module.
Figure 7B:
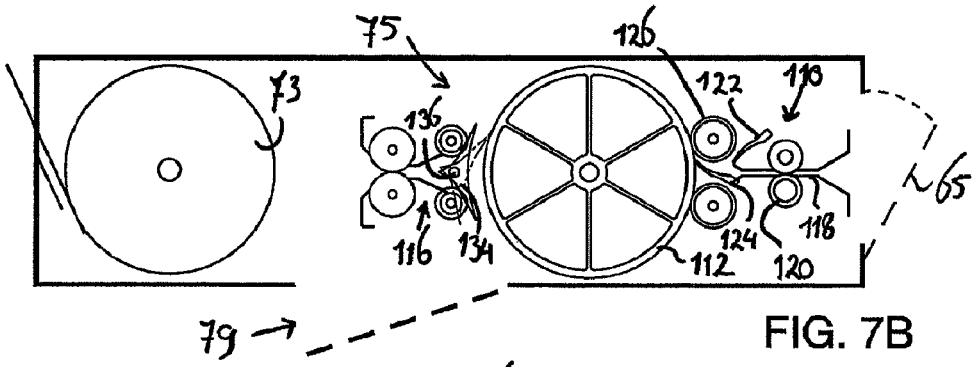

FIG. 7A illustrates a folding module comprising a selectably operable valve 65 for guiding a processed receiving media into the folding device 75 and a front delivery station 101. FIG. 7B further comprises an additional roll of receiving media 73 and has a bottom exit 79. In the embodiments depicted in FIGS. 7A and 7B, the folding device comprises a feed unit 110, a folding substrate which, in this embodiment, is configured as a cylindrical drum 112, and a pair of pinch and guide structures (not shown) that are arranged symmetrically with respect to the feed unit 110 at the peripheral surface of the drum 112. A discharge unit 116 is arranged in a position diametrically opposite to the feed unit 110.

The feed unit 110 comprises a guide channel 118 arranged for a sheet of processed receiving media (not shown), vertically downward onto the peripheral surface of the drum 112. A pair of feed rollers 120 form a nip in the supply channel 118. At least one of the feed rollers 120 is driven, so as to control the supply of the sheets to the drum 112.

Two deflection fingers 122 and 124 are arranged at the downstream end of the feed unit 112 for deflecting the sheets at the transit point between the feed unit 110 and the surface of the drum 112. The deflection fingers 122, 124 are adjustable by means of a set mechanism that has not been shown, so that they may optionally be brought into an operative position. In the example shown in FIG. 7A, the deflection finger 124 is in the operative position.

Each pinch and guide structure comprises a pinch roller 126 and an endless belt (not shown) or rather an array of several parallel belts that are trained around the pinch roller 126 and two deflection rollers (not shown). The pinch roller 126 and the deflection rollers are arranged such that a portion of the belt is held in mating engagement with the peripheral surface of the drum 112. In the example shown, that portion extends over an angle of almost 180° from the feed unit 110 to the discharge unit 116. The belt may be elastic, or one of the deflection rollers, e.g., the roller, may be supported elastically so as to hold the belt under appropriate tension, so that the portion will suitably be pressed against the surface of the drum 112.

The drum 112 is connected to a drive mechanism (not shown) so as to be rotatable in either direction about its central axis. The belts and the pinch rollers and deflection rollers may be driven through frictional contact with the peripheral surface of the drum 112. Preferably, however, one of the pinch rollers 126 and deflection rollers of each pinch and guide structure is driven actively by means of a drive mechanism (not shown).

The discharge unit 116 comprises a discharge gate 134 that is disposed between the two deflection rollers and is pivotable about an axis 136. Further, a pair of discharge rollers 138 form a transport nip below the deflection rollers.

Figure 7C:
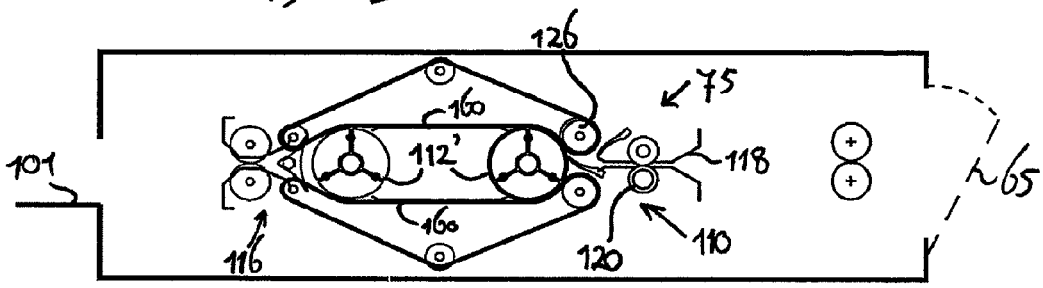
Figure 7D:
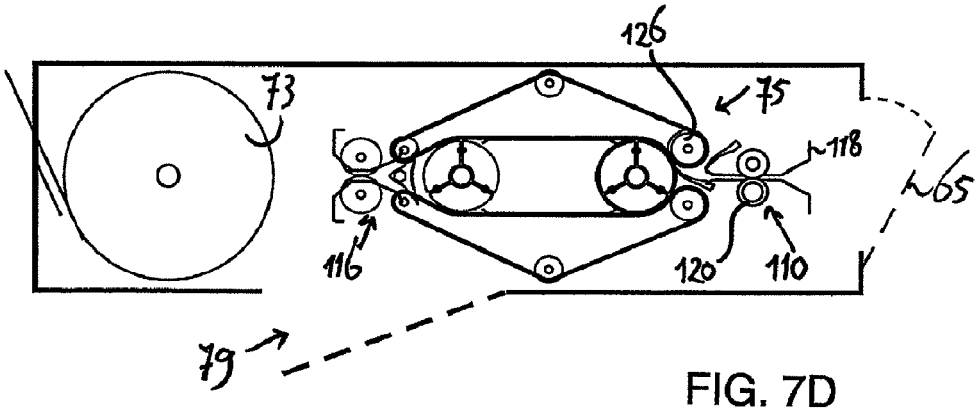

FIG. 7C shows a folding module comprising a selectably operable valve 65 for guiding a processed receiving media into the folding device 75 and a front delivery station 101. FIG. 7D further comprises an additional roll of receiving media 73 and has a bottom exit 79. In the embodiments depicted in FIGS. 7C and 7D, the folding device is shown, wherein the folding substrate is formed by two separate smaller drums 112' that are arranged in parallel and are connected by stationary guides 160 which, together with the belts 128, define a closed circulation path for the sheets. Here, the belts 128 have straight portions running along the guides 160 without pressing against these guides or pressing only moderately there against, so that the sheets or sheet portions, when passing along the guide 160, will not experience any substantial friction or shearing strains.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A printing system for roll receiving media, comprising:

a media storage module for storing at least one roll of receiving media;

a printing station for processing a portion of the roll receiving media;

a receiving station for receiving the processed media;

a base member for supporting the printing system on a support surface;

a receiving device configured to receive a folding module which has both a cooperation device adapted to be positioned at a circumference of the folding module and a folding device for folding the processed roll receiving media, the receiving device being positioned substantially in a volume extending from the area defined by the cumulative normal projection of the media storage module and the printing station on the support surface, the volume extending perpendicular to the support surface in the direction of the printing station;

the folding module; and a guiding device configured to guide the processed media to one of the receiving station and the folding module, wherein the media storage module for storing at least one roll of receiving media is also positioned substantially in the volume extending from the area defined by the cumulative normal projection of the media storage module and the printing station on the support surface, the volume extending perpendicular to the support surface in the direction of the printing station, and wherein the folding module is adapted to store at least one roll of receiving media.

2. A folding module for folding a processed receiving media, comprising:

a cooperation device adapted to be positioned at a circumference of the folding module for cooperation with the receiving device of the printing system according to claim 1; and a folding device configured to fold the processed receiving media.

3. The folding module according to claim 2, further comprising a media feed device configured to feed a media into the folding device.

4. The folding module according to claim 3, wherein the media feed device is, in an operative state, able to correct for media skew.

5. The folding module according to claim 2, wherein the folding device comprises:

a rotatable folding cylinder;

a first and a second rotatable press member, each capable of engaging with said rotatable folding cylinder to form respectively a first and a second folding pinch;

a medium feed device configured to feed the medium towards the folding cylinder in between said first and second folding pinches; and a control device that is capable of alternating the rotational direction of the rotatable folding cylinder in an operative state during a folding program and controllably drive the medium feed device to feed the medium during a folding program towards the folding cylinder.

6. The folding module according to claims 5, wherein the medium feed device is positioned in close proximity to the folding cylinder.

7. The folding module according to claim 2, further comprising an output device, configured to eject a folded processed media.

8. The folding module according to claim 2, wherein the folding module has substantially the same outside dimensions as the media storage module for storing at least one roll of receiving media of the printing system.

9. A method of modifying the printing system of claim 1, comprising the steps of:

removing the media storage module from the printing system thereby creating a vacancy in the volume; and inserting the folding module into the vacancy.

10. The method according to claim 9, wherein the media storage module and the folding module are removably connectable to the printing system by the receiving device.

11. The printing system according to claim 1, further comprising a media feed device configured to feed a media into the folding device.

12. The printing system according to claim 11, wherein the media feed device is, in an operative state, able to correct for media skew.

13. The printing system according to claim 1, wherein the folding device comprises:

a rotatable folding cylinder;

a first and a second rotatable press member, each capable of engaging with said rotatable folding cylinder to form respectively a first and a second folding pinch;

a medium feed device configured to feed the medium towards the folding cylinder in between said first and second folding pinches; and a control device that is capable of alternating the rotational direction of the rotatable folding cylinder in an operative state during a folding program and controllably drive the medium feed device to feed the medium during a folding program towards the folding cylinder.

14. The printing system according to claim 13, wherein the medium feed device is positioned in close proximity to the folding cylinder.

15. The printing system according to claim 1, further comprising an output device, configured to eject a folded processed media.

16. The printing system according to claim 1, wherein the folding module has substantially the same outside dimensions as the media storage module for storing at least one roll of receiving media of the printing system.

* * * * *